US008221184B2

(12) United States Patent
Nuttall et al.

(10) Patent No.: US 8,221,184 B2
(45) Date of Patent: Jul. 17, 2012

(54) FLOATING TOY

(75) Inventors: Michael Nuttall, South Pasadena, CA (US); Stacy Lynn O'Connor, Long Beach, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 13/098,874

(22) Filed: May 2, 2011

(65) Prior Publication Data

US 2011/0244755 A1 Oct. 6, 2011

Related U.S. Application Data

(63) Continuation-in-part of application No. 12/766,796, filed on Apr. 23, 2010.

(60) Provisional application No. 61/329,928, filed on Apr. 30, 2010, provisional application No. 61/173,105, filed on Apr. 27, 2009.

(51) Int. Cl.
*A63H 23/00* (2006.01)

(52) U.S. Cl. ..... 446/153; 446/166

(58) Field of Classification Search ..... 446/153, 446/156, 157, 173, 174, 429, 430, 433, 444, 446/445, 448, 473
See application file for complete search history.

(56) References Cited

U.S. PATENT DOCUMENTS 1,715,891 A 6/1929 Beck
1,893,507 A 1/1933 Ranney
3,204,574 A 9/1965 Frisbie et al.
3,209,491 A 10/1965 Roeper
3,359,920 A 12/1967 Iammatteo
3,577,675 A 5/1971 Kohner et al.
3,858,875 A 1/1975 Nemeth et al.
3,908,989 A 9/1975 Meyer
4,094,089 A 6/1978 Sano
4,185,409 A 1/1980 Cheng
4,223,894 A 9/1980 Fabricant
4,235,378 A 11/1980 Melin et al.
4,249,733 A 2/1981 Eddins et al.
4,348,028 A 9/1982 Barlow
4,355,807 A 10/1982 Prehodka
4,513,966 A 4/1985 Mucaro et al.
(Continued)

OTHER PUBLICATIONS

International Search Report for International Application No. PCT/US2010/032302 mailed Feb. 9, 2011.

(Continued)

*Primary Examiner* — Nini Legesse
(74) *Attorney, Agent, or Firm* — Cantor Colburn LLP

(57) ABSTRACT

A floatable toy structure is disclosed herein, the floatable toy structure having: a floatable base portion; a collapsible track section secured to the floatable base portion, the collapsible track section capable of being positioned in an extended position and a stowed position, the collapsible track section extending upwardly from the floatable base portion when it is in the extended position; a support secured to the floatable base portion, the support configured to support the collapsible track section in the extended position; a pump for spraying water from a spray nozzle movably secured to the floatable toy structure; and a gate pivotally mounted to the floatable toy structure proximate to the collapsible track section, the gate being configured for movement between a first position and a second position, the gate further comprising a vessel for holding water therein, wherein the gate moves from the first position to the second position when a predetermined amount of water is placed into the vessel and wherein the gate moves away from the collapsible track section as it moves from the first position towards the second position.

20 Claims, 15 Drawing Sheets

U.S. PATENT DOCUMENTS

| | | | | |
|---|---|---|---|---|
| 4,536,168 | A | 8/1985 | Stephens | |
| 4,585,166 | A * | 4/1986 | Stephens | 238/10 R |
| 4,689,032 | A * | 8/1987 | Trossman | 446/160 |
| D305,676 | S | 1/1990 | Ngai | |
| 5,336,122 | A | 8/1994 | Lewis | |
| 5,683,298 | A | 11/1997 | Jackson | |
| 6,216,600 | B1 | 4/2001 | Verret | |
| 6,905,388 | B2 | 6/2005 | Schoonmaker | |
| 7,618,302 | B2 * | 11/2009 | Collins et al. | 446/174 |
| 7,690,964 | B2 | 4/2010 | Nuttall et al. | |
| 2005/0176338 | A1 | 8/2005 | Delaney | |
| 2005/0287916 | A1 | 12/2005 | Sheltman et al. | |
| 2006/0128256 | A1 * | 6/2006 | Collins et al. | 446/73 |
| 2007/0049160 | A1 | 3/2007 | Matthes et al. | |
| 2007/0128969 | A1 | 6/2007 | Shrock et al. | |
| 2007/0197127 | A1 | 8/2007 | Ostendorff et al. | |
| 2007/0293123 | A1 | 12/2007 | Nuttall et al. | |
| 2008/0009219 | A1 | 1/2008 | Nuttall et al. | |
| 2008/0020675 | A1 | 1/2008 | Ostendorff | |
| 2008/0081536 | A1 | 4/2008 | Payne et al. | |
| 2009/0004949 | A1 | 1/2009 | Payne | |

OTHER PUBLICATIONS

Written Opinion of the International Searching Authority for International Application No. PCT/US2010/032302 mailed Feb. 9, 2011.

* cited by examiner

FLOATING TOY

CROSS REFERENCE TO RELATED APPLICATIONS

The application claims the benefit of U.S. Provisional Patent Application Ser. No. 61/329,928 filed Apr. 30, 2010, the contents of which are incorporated herein by reference thereto.

The application is also Continuation-in-Part of U.S. patent application Ser. No. 12/766,796, filed Apr. 23, 2010, which claims the benefit of U.S. Provisional Patent Application Ser. No. 61/173,105 filed Apr. 27, 2009, the contents each of which are incorporated herein by reference thereto.

BACKGROUND

Various embodiments of the present invention are related to toys in particular, a floating structure for use with toy vehicles.

Toy vehicle track sets have been popular for many years and generally include one or more track sections arranged to form a path around which one or more toy vehicles can travel. Toy vehicles which may be used on such track sets may be either self-powered vehicles or may receive power from an external source. In order to increase play value of the track sets, it is desirable to add track amusement features to the track sets. Furthermore, you children enjoy playing with toys in the water whether it is a tub, pool, beach etc.

Accordingly, it is desirable to provide a toy structure that will provide variations in play and is capable of being used in a body of water.

SUMMARY OF THE INVENTION

In one embodiment, a floatable toy structure is provided, the floatable toy structure having: a floatable base portion; a collapsible track section secured to the floatable base portion, the collapsible track section capable of being positioned in an extended position and a stowed position, the collapsible track section extending upwardly from the floatable base portion when it is in the extended position; a support secured to the floatable base portion, the support configured to support the collapsible track section in the extended position; a pump for spraying water from a spray nozzle movably secured to the floatable toy structure; and a gate pivotally mounted to the floatable toy structure proximate to the collapsible track section, the gate being configured for movement between a first position and a second position, the gate further comprising a vessel for holding water therein, wherein the gate moves from the first position to the second position when a predetermined amount of water is placed into the vessel and wherein the gate moves away from the collapsible track section as it moves from the first position towards the second position.

In another embodiment, a floatable toy structure is provided, the floatable toy structure having: a floatable base portion; a collapsible track section secured to the floatable base portion, the collapsible track section capable of being positioned in an extended position and a stowed position, the collapsible track section extending upwardly from the floatable base portion when it is in the extended position; a support secured to the floatable base portion, the support configured to support the collapsible track section in the extended position; a pump for spraying water from a spray nozzle movably secured to the floatable toy structure; and a platform pivotally mounted to the floatable toy structure, the platform being configured for movement between a first position and a second position, the platform further comprising at least one vessel for holding water therein, wherein the platform moves from the first position to the second position when a predetermined amount of water is placed into the at least one vessel and wherein the platform moves from a substantially horizontal position to an inclined position as it moves from the first position towards the second position, wherein an object placed on the platform will be dislodged therefrom as the platform moves from the first position to the second position.

In still another embodiment, a method of releasing objects from a floatable toy structure is provided, the method including the steps of: pivotally mounting a gate to the floatable toy structure, the gate being located proximate to a collapsible track section of the floatable toy structure, the gate being configured for movement between a first position and a second position, the gate further comprising a vessel for holding water therein, wherein the gate moves from the first position to the second position when a predetermined amount of water is placed into the vessel and wherein the gate moves away from the collapsible track section as it moves from the first position towards the second position; and pumping water into the vessel of the gate in order to move the gate to the second position, wherein an object placed behind the gate will travel down the collapsible track section after the gate moves to the second position.

BRIEF DESCRIPTION OF THE DRAWINGS

Other features, advantages and details appear, by way of example only, in the following description of embodiments, the description referring to the drawings in which:

FIGS. 5 and 6 illustrate a pump of the toy structure illustrated in

FIGS. 1-4;

DETAILED DESCRIPTION

Figure 1:
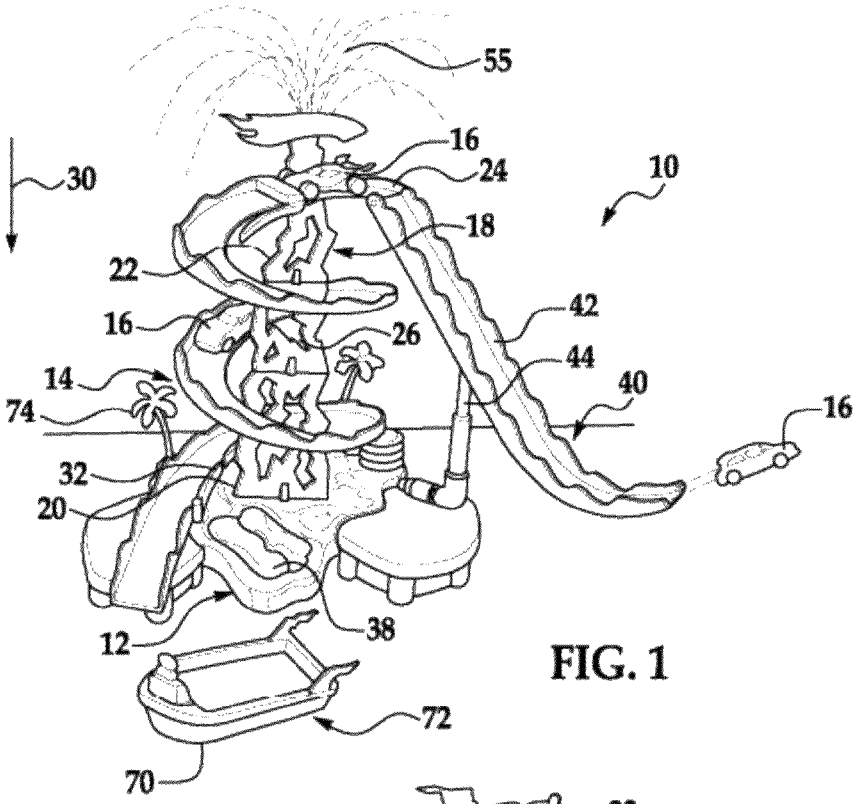
FIGS. 1-4 are perspective views of a toy structure in accordance with an exemplary embodiment of the present invention.
Figure 2:
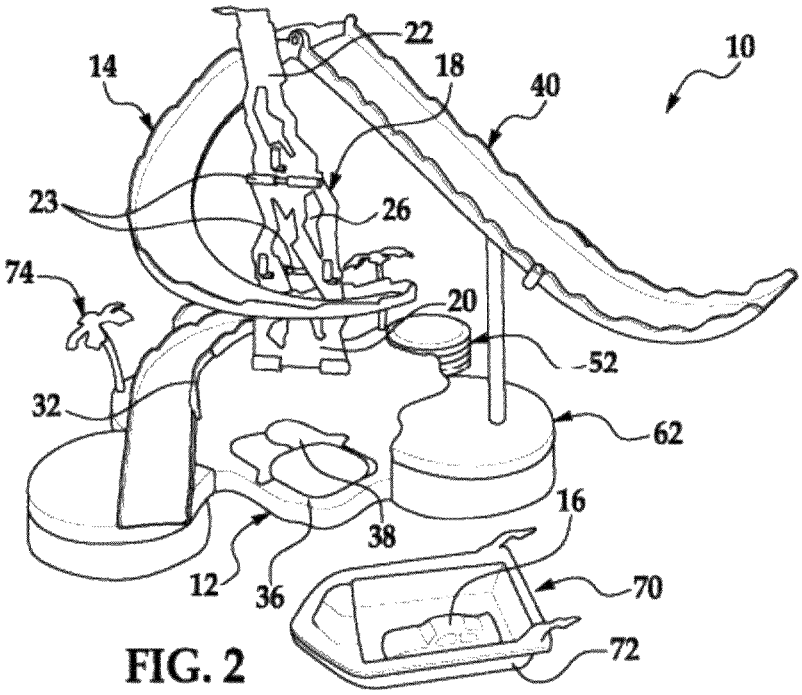
Figure 3:
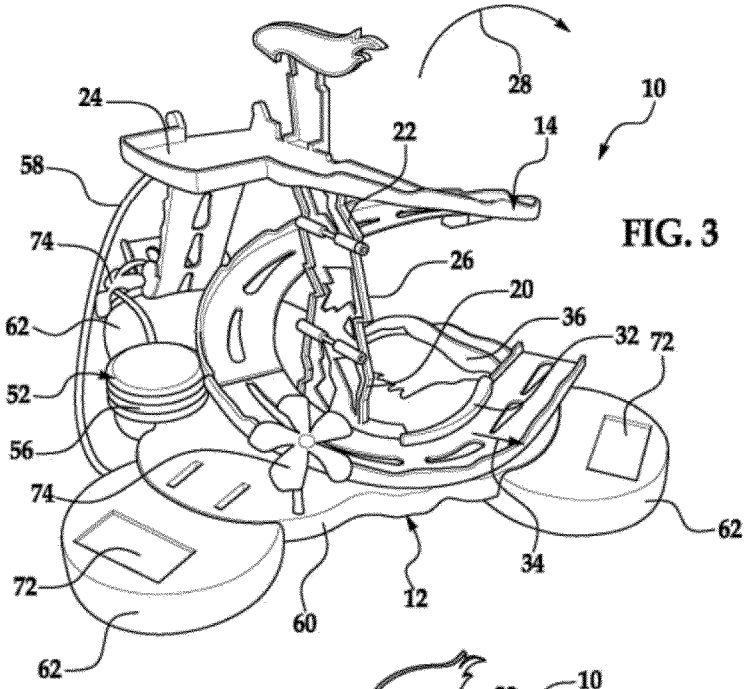
Figure 4:
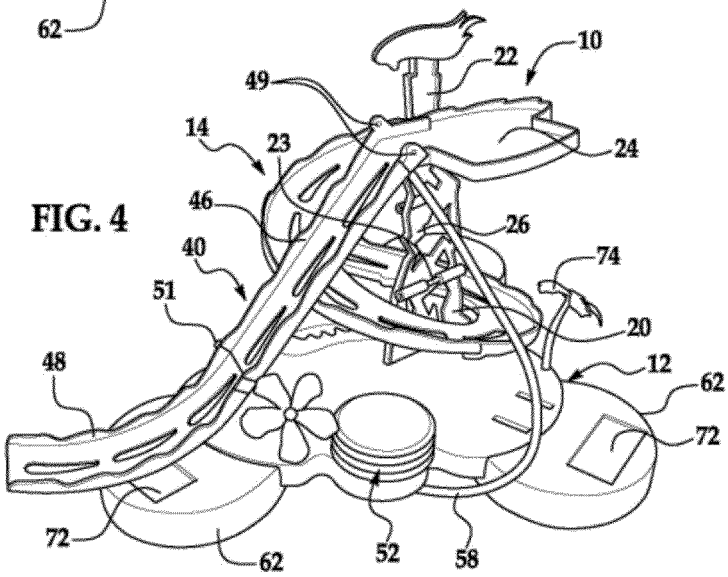

In accordance with various embodiments of the present invention and referring now to FIGS. 1-13, a floatable toy structure 10 is illustrated. As illustrated, the floatable toy structure has a floatable base portion 12 and a collapsible track section 14 secured to the floatable base portion. The collapsible track section is generally curved to provide a spiral path for an object 16 such as a toy vehicle to travel down. As illustrated in the attached FIGS. the collapsible track section is capable of being positioned in an extended position FIGS. 1-4 and 7-9 and a stowed position FIGS. 10 and 11. The collapsible track section extends upwardly from the floatable base portion when it is in the extended position to provide a path for an object to travel down and splash into the water that the toy structure is floating in. Of course, any other releasable means for securing the collapsible support and the collapsible track section in their extended positions is contemplated.

In order to support the collapsible track section in the extended position, a collapsible support 18 is secured to the floatable base portion. The collapsible support being capable of being positioned in an extended position FIGS. 1-4 and 7-9 and a stowed position FIGS. 10 and 11. Similarly to the collapsible track section the collapsible support extends upwardly from the floatable base portion when it is in the extended position. In order to maintain the collapsible track section in the extended position, the collapsible support engages and maintains the collapsible track section in the extended position when the collapsible support is in the extended position. For example, a hook member of the collapsible track section engages a catch of the collapsible support. Of course, any other suitable means for securement between the collapsible track section and the collapsible tower section is contemplated.

As illustrated, the collapsible support has at least a lower or first member 20 and an upper or second member 22 each being pivotally secured to each other by for example, a plurality of pins 23 of course, any other equivalent structure may be used to pivotally secure the members of the collapsible support. The first member is also pivotally secured to the floatable base portion and the second member is configured to engage and support a portion or platform 24 of the collapsible track section. In one embodiment a third or middle member 26 is disposed between the first and second members such that the first member is pivotally secured to the middle member at one end and the second member is pivotally secured to the middle member at another end. In addition and in one embodiment, the first member and the second member are configured such that pivotal movement of the first member with respect to the base portion and pivotally movement of the second member with respect to the first portion in the direction of arrow 28 is limited by for example surfaces and/or angular configurations of the first member and the second member such that a downward force in the direction of arrow 30 by for example the collapsible track section will maintain the collapsible support in the upright or extended position.

In one non-limiting exemplary embodiment, the floatable toy structure is formed from an easily molded material such a plastic and the collapsible track section is formed from a material having resilient characteristics such that it can be extended from the stowed position to the extended position and the collapsible track section will have a tendency to apply a downward force in the direction of arrow 30 when in the extended position such that the collapsible track section and the collapsible support are maintained in the extended position when portion 24 engages the second member of the collapsible support.

Figure 10:
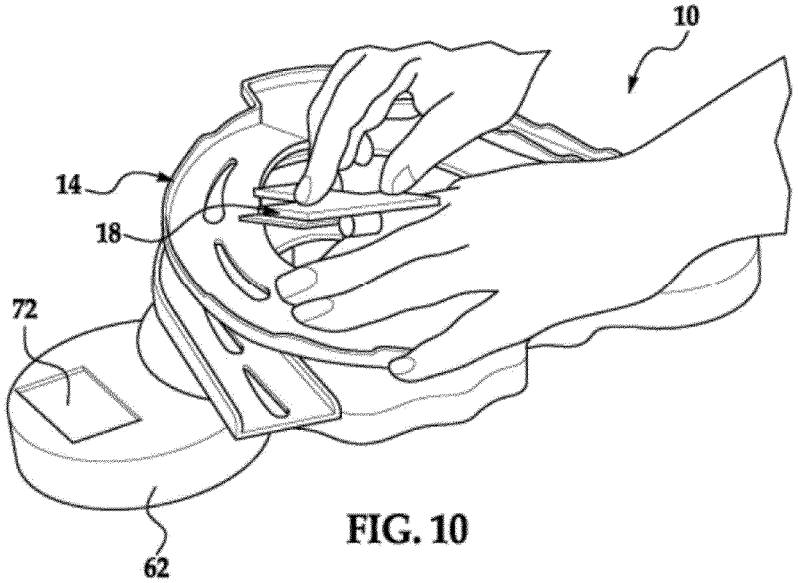
FIGS. 10 and 11 illustrates the toy structure in a collapsed or stowed configuration.
Figure 11:
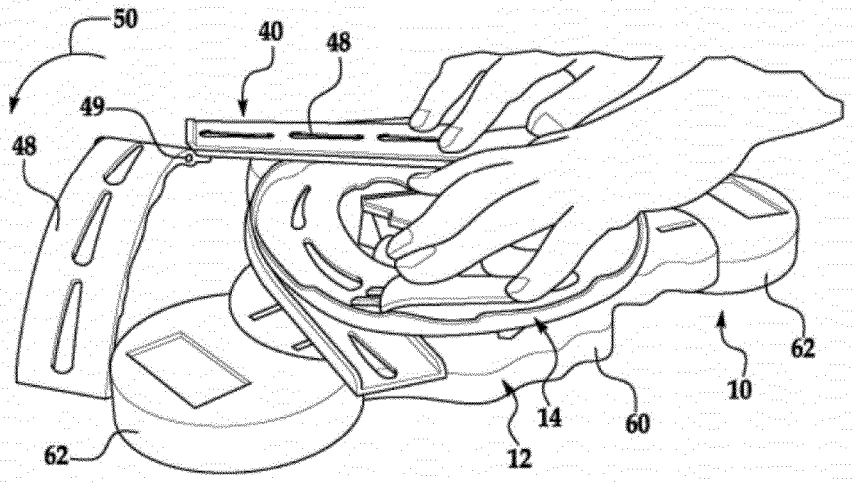

In order to stow the floatable toy structure a user simply applies a force to the collapsible track section in a direction opposite to arrow 30 so as to disengage portion 24 from the collapsible support by moving the same slightly upward and away from the collapsible track section and then collapsible support and track section are free to collapse thereby allowing the floatable toy structure to be placed in the configuration of FIGS. 10-11.

As illustrated in FIGS. 1-3 and 7, a diverter section 32 is pivotally mounted to a portion of the collapsible track section for movement between a first position wherein the diverter section allows a car to travel down the collapsible track section and a second position wherein the diverter section is moved into the track in the direction of arrow 34 and an object (e.g., toy car) travelling down the collapsible track section will be diverted from the collapsible track section and into an opening 36 disposed in the floatable base portion of the floatable toy structure. In one embodiment, the diverter section has a curved configuration to divert the car off of the track and into the opening. In essence, diverter section 32 is a switch track for altering the path of an object (e.g., toy car or other item) travelling down the collapsible track section.

In one embodiment, the opening 36 is shaped to resemble a shark's or other creature's mouth. In still another embodiment, the opening 36 has a collapsible trap door 38 that opens when the object (e.g., toy car or other item) hits it.

As illustrated, the floatable toy structure also has another track section 40 pivotally secured to the collapsible track section for example platform 24 such that a downward path 42 from the platform 24 is provided when the collapsible track section is in the extended position. Track section 40 is also adjustably and removably secured to the floatable base portion at another location remote from the point of pivotal securement to the collapsible track section via an extendable support 44 to provide adjustable configurations of track section 40 as illustrated by the dashed lines in FIG. 7. Accordingly, an adjustable path or jump with adjustable heights for an object (e.g., toy car or other item) to travel down is provided.

Figure 9:
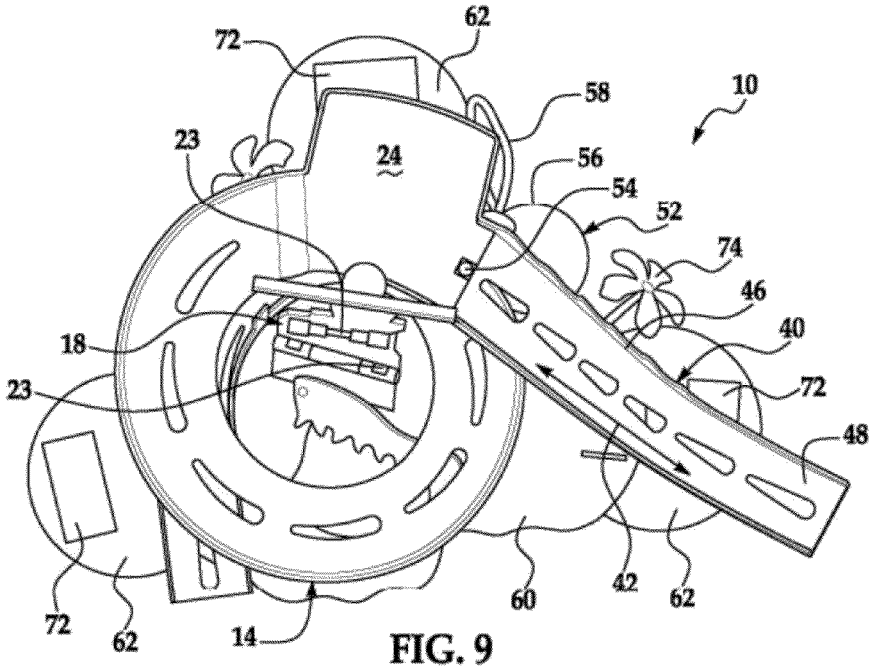
FIG. 9 is a top view of the toy structure of exemplary embodiments of the present invention.

Referring now to FIGS. 4, 7, 9 and 11 track section 40 has an upper portion 46 and a lower portion 48, the upper portion being pivotally secured to the collapsible track section at for example, the platform via mounting pins 49 or any other equivalent structure at one end and the lower portion being removably and adjustably secured to the floatable base portion via support 44 at another location remote from the pivotal securement to the collapsible track section. In addition, the lower portion is also pivotally secured to the upper portion via a mounting pin or equivalent structure such that the same may be pivoted away from the upper portion to allow for stowing of the floatable toy structure as illustrated in FIGS. 9 and 11. Moreover, the pivotal securement of the upper portion to the collapsible track section allows the same to be pivoted in the direction of arrow 50 away from its deployed position FIGS. 1-4, 7, 8 and 9 to the stowed position FIGS. 10 and 11.

Referring to at least FIGS. 1, 4-6, 8 and 9 and in accordance with an exemplary embodiment of the present invention and since the floatable toy structure is intended for use in a body of water, the floatable toy structure further comprises a pump 52 for spraying water from a spray nozzle 54 secured to the floatable toy structure. FIG. 1 illustrates a plume 55 of water being sprayed by spray nozzle 54. In one embodiment, the pump is a compressible bellows 56 secured to the floatable base portion and the spray nozzle 54 is secured to an upper portion the collapsible track section and a flexible conduit 58 fluidly connects the pump to the spray nozzle.

Figure 5:
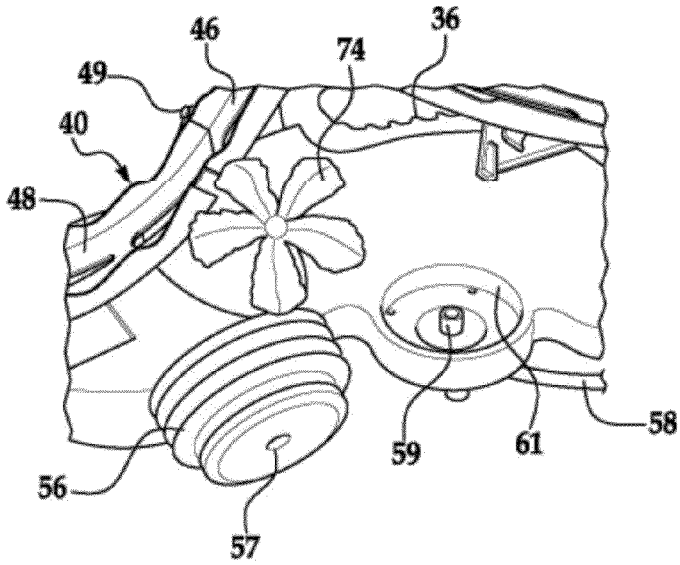

As shown in FIG. 5, the bellows has an opening 57 configured to engage a conduit 59 disposed in a recessed area 61, wherein fluid in bellows 56 is pumped into conduits 59 and 58. Although, a bellows type pump is illustrated any other manual type pump may be employed to pump water into conduit 58 and spray it from nozzle 54.

Figure 6:
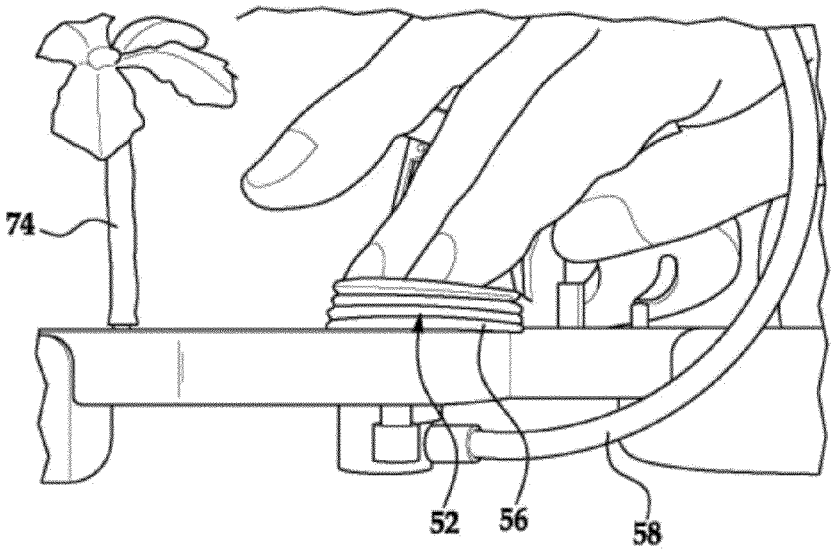
Figure 7:
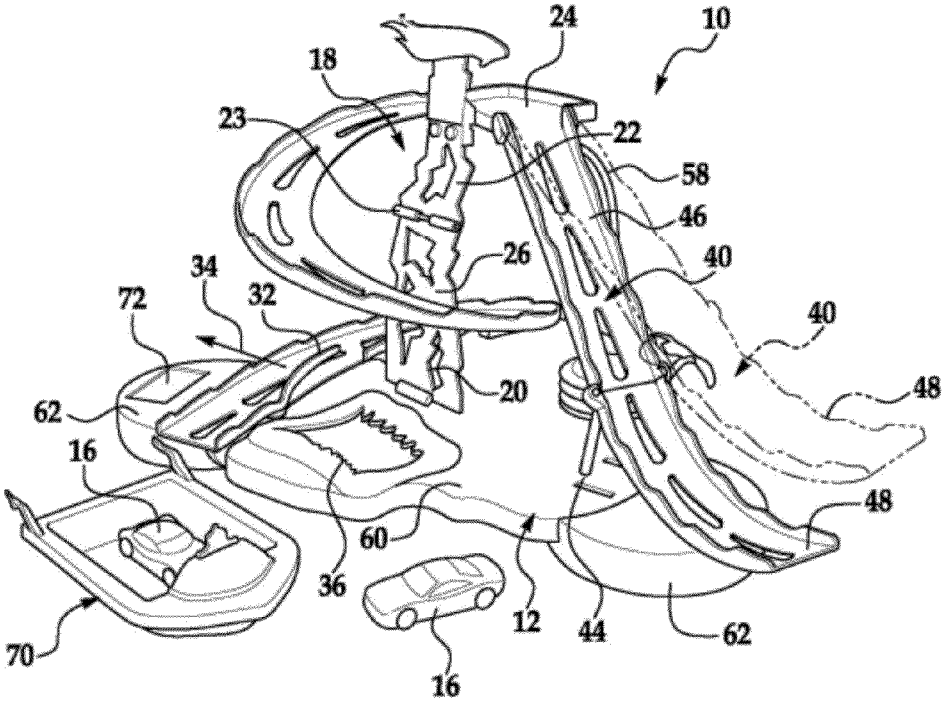
FIG. 7 is a perspective view of the toy structure illustrating operation thereof.
Figure 8:
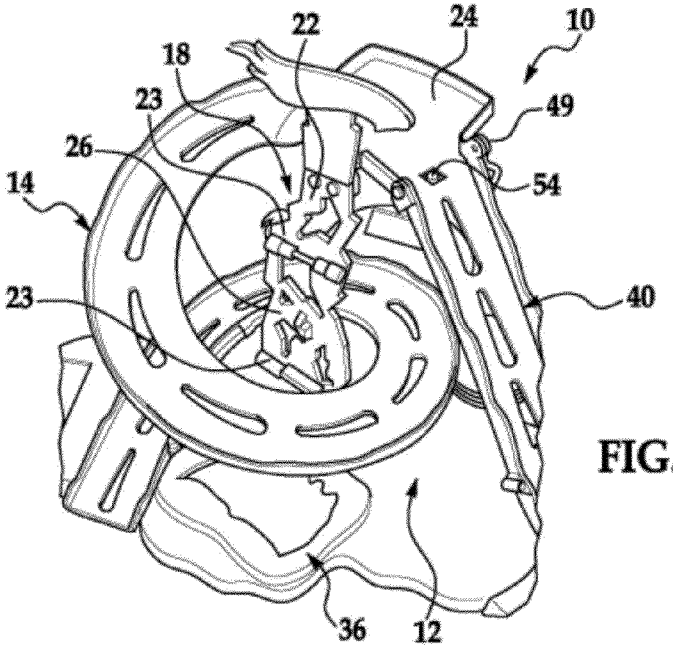
FIG. 8 is a top perspective view of the toy structure.

Accordingly and as a user presses the bellows to a compressed state illustrated in FIG. 6, fluid in the bellows is pushed through the conduit and out nozzle 54. Thereafter and as the bellows expands a vacuum is created in the bellows and more fluid is drawn back into the bellows via a one way valve for expulsion back out of nozzle as the bellows is compressed once again. In one non-limiting exemplary embodiment, the one way valve is enclosed a housing 63 illustrated in at least FIG. 13, wherein the one way valve is in fluid communication with the body of water the floatable toy structure is placed in as well as the bellows to provide a means for pumping fluid to the nozzle from the pump.

As illustrated in the attached FIGS., the floatable base platform of the floatable toy structure comprises a base platform 60 and a plurality of floats 62 secured thereto in order to provide buoyancy to the floatable base platform. In one non-limiting embodiment, the floats are positioned to provide stability to the structure in both water and non-water play.

Figure 12:
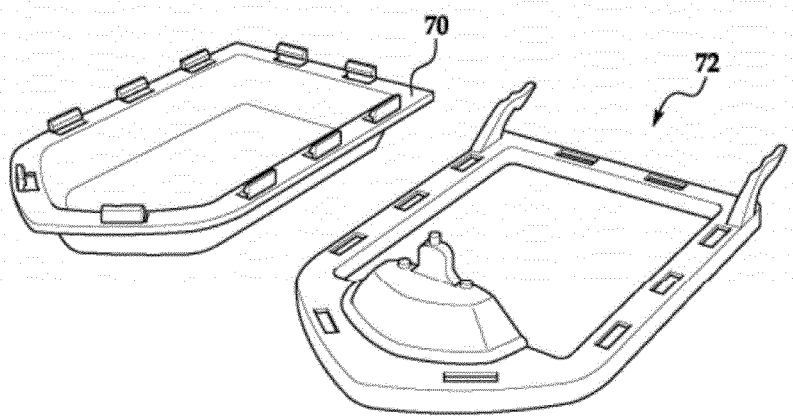
FIG. 12 illustrates an accessory for use with the toy structure.
Figure 13:
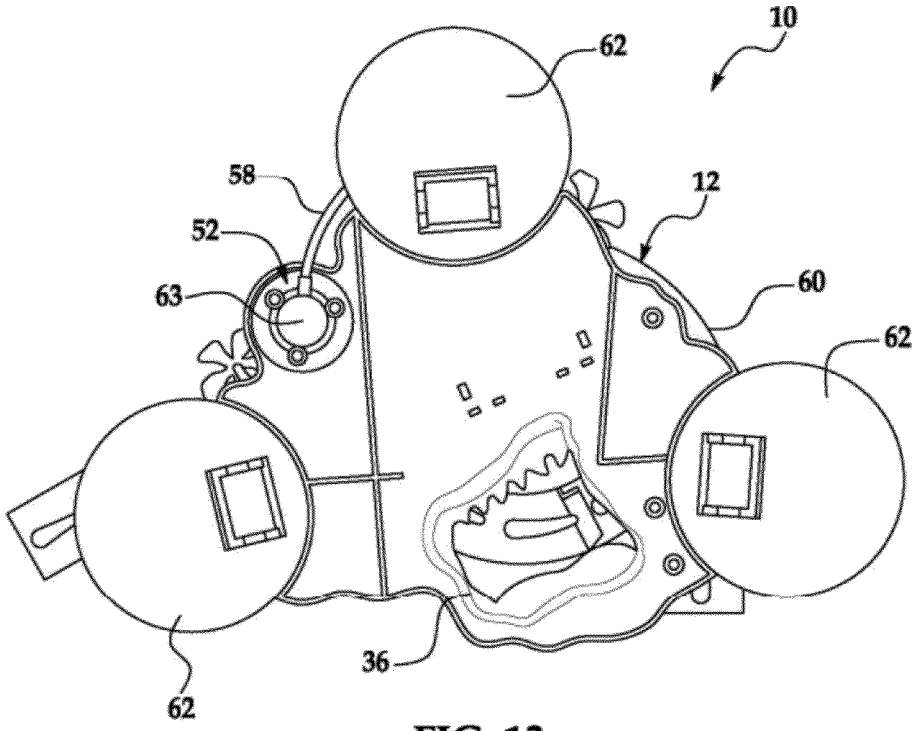
FIG. 13 is a bottom view of the toy structure of exemplary embodiments of the present invention.

In addition, a toy boat 70 is also provided for use with the floatable toy structure. Toy boat 70 has a hull portion 72 with a see-though bottom so that a user may look in the body of water for vehicles that have travelled down the track paths of the floatable toy structure or passed into opening 36 via diverter 32. In addition, the boat provides an area into which vehicles travelling down track section 40 may received after they are launched into air thus providing a target for the user to aim their cars at which provides enhanced play. FIG. 12 shows boat 70 in an unassembled configuration. The floatable toy structure also has a plurality of spaces 72 for placement of toy cars or vehicles of objects so that a user may retain them there during play in a body of water. The numerous amount of spaces allows for many objects to be placed on the floating structure for enhanced play.

In one non-limiting embodiment, the floatable toy structure is configured to resemble an island with palm trees 74 and other decorative attachments for enhanced play.

Referring now to FIGS. 14-22, an alternative embodiment of the present invention is illustrated. Here components performing similar or analogous features are labeled in multiples of 100.

Here a floatable toy structure 110 is illustrated. As illustrated, the floatable toy structure has a floatable base portion 112 having a plurality of floats 162 and a collapsible track section 114 secured to the floatable base portion. The collapsible track section is generally curved to provide a spiral path for an object 116 such as a toy vehicle to travel down. The collapsible track section is capable of being positioned in an extended position and a stowed position. Alternatively, the track section is not collapsible and is merely secured to the floatable base portion in an extended manner.

The collapsible track section extends upwardly from the floatable base portion when it is in the extended position to provide a path for an object to travel down and splash into the water that the toy structure is floating in. Of course, any other releasable means for securing the collapsible support and the collapsible track section in their extended positions is contemplated.

In order to support the collapsible track section in the extended position, a collapsible support or supports 118 is/are secured to the floatable base portion. The collapsible support being capable of being positioned in an extended position and a stowed position. Similarly to the collapsible track section the collapsible support extends upwardly from the floatable base portion when it is in the extended position. In order to maintain the collapsible track section in the extended position, the collapsible support engages and maintains the collapsible track section in the extended position when the collapsible support is in the extended position. For example, a hook member of the collapsible track section engages a catch of the collapsible support. Of course, any other suitable means for securement between the collapsible track section and the collapsible tower section is contemplated.

In one non-limiting exemplary embodiment, the floatable toy structure is formed from an easily molded material such a plastic and the collapsible track section is formed from a material having resilient characteristics such that it can be extended from the stowed position to the extended position and the collapsible track section will have a tendency to apply a downward force in the direction of arrow 130 when in the extended position such that the collapsible track section and the collapsible support are maintained in the extended position when a portion of the track engages the collapsible support.

In order to stow the floatable toy structure a user simply applies a force to the collapsible track section in a direction opposite to arrow 130 so as to the track from the collapsible support by moving the same slightly upward and away from the collapsible track section and then the collapsible support and track section are free to collapse thereby allowing the floatable toy structure to be placed in a stowable configuration.

The floatable toy structure further comprises a pump 152 for spraying water from a spray nozzle 154 movable secured to the floatable toy structure. In one embodiment, the pump is a compressible bellows 156 secured to the floatable base portion and the spray nozzle 154 is movably (e.g., rotationally and/or pivotally) secured to a portion the collapsible track section and a flexible conduit 158 fluidly connects the pump to the spray nozzle.

As previously mentioned the bellows has an opening, wherein fluid in the bellows is pumped into conduit 158 and ultimately sprayed out of the spray nozzle. Although, a bellows type pump is illustrated any other manual type pump may be employed to pump water into conduit 158 and spray it from nozzle 154.

Accordingly and as a user presses the bellows to a compressed state illustrated fluid in the bellows is pushed through the conduit and out nozzle 154. Thereafter and as the bellows expands a vacuum is created in the bellows and more fluid is drawn back into the bellows via a one way valve for expulsion back out of nozzle as the bellows is compressed once again. In one non-limiting exemplary embodiment, the one way valve is enclosed a housing, wherein the one way valve is in fluid communication with the body of water the floatable toy structure is placed in as well as the bellows to provide a means for pumping fluid to the nozzle from the pump.

Figure 19:
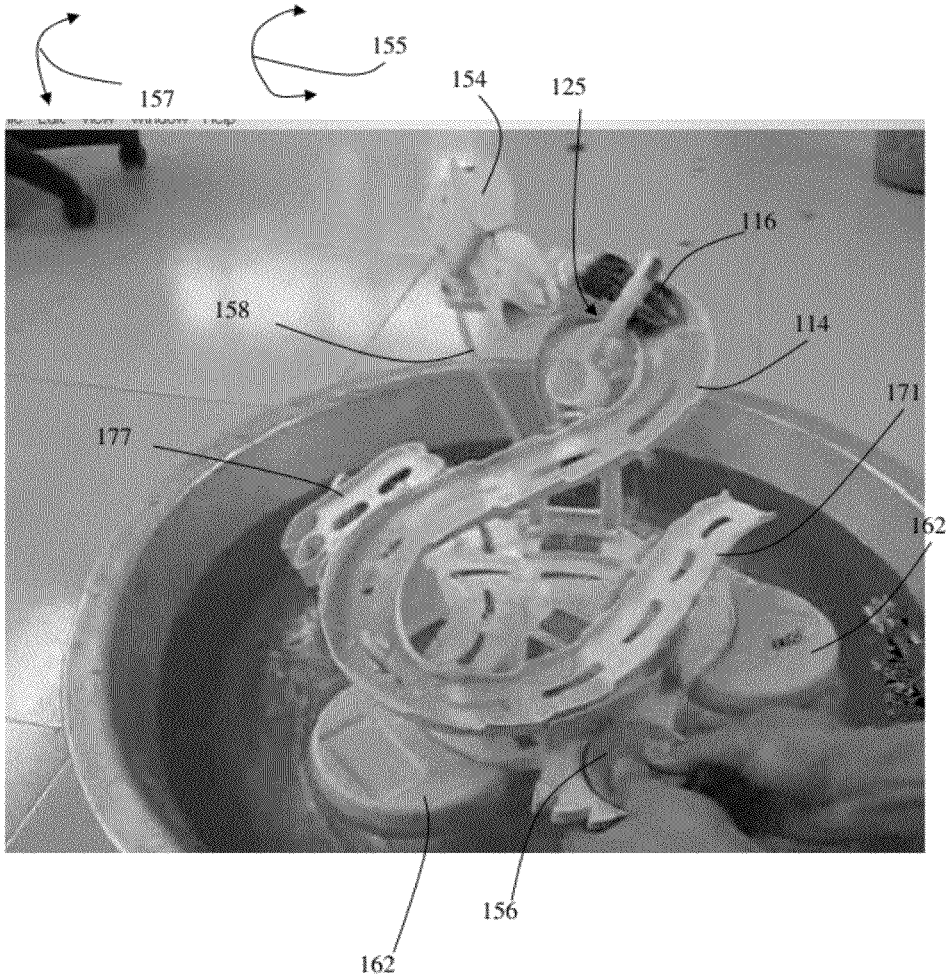
Figure 20:
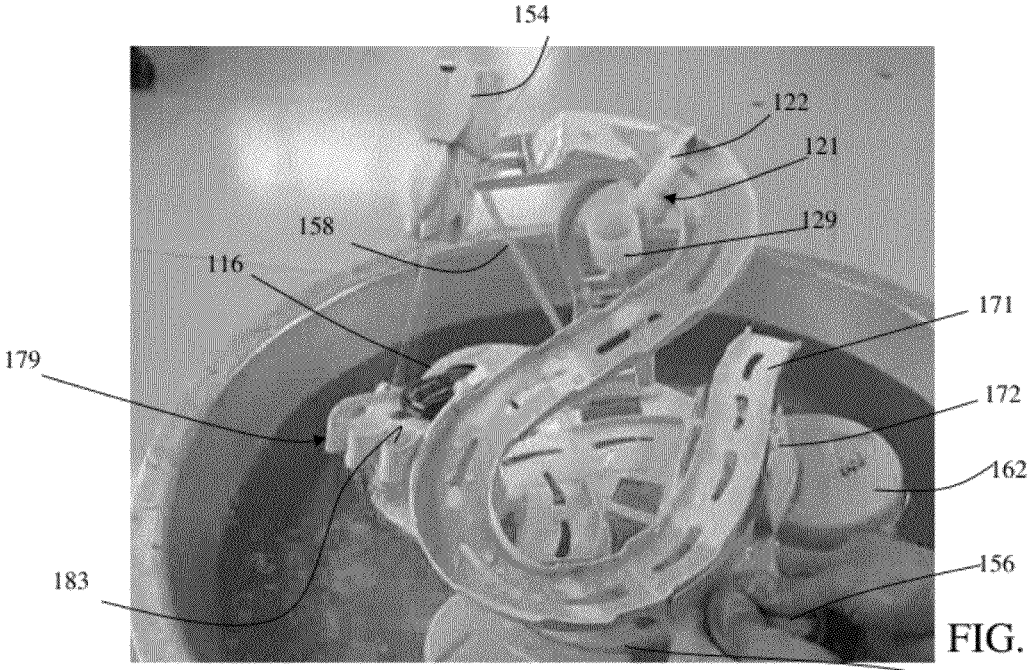
Figure 21:
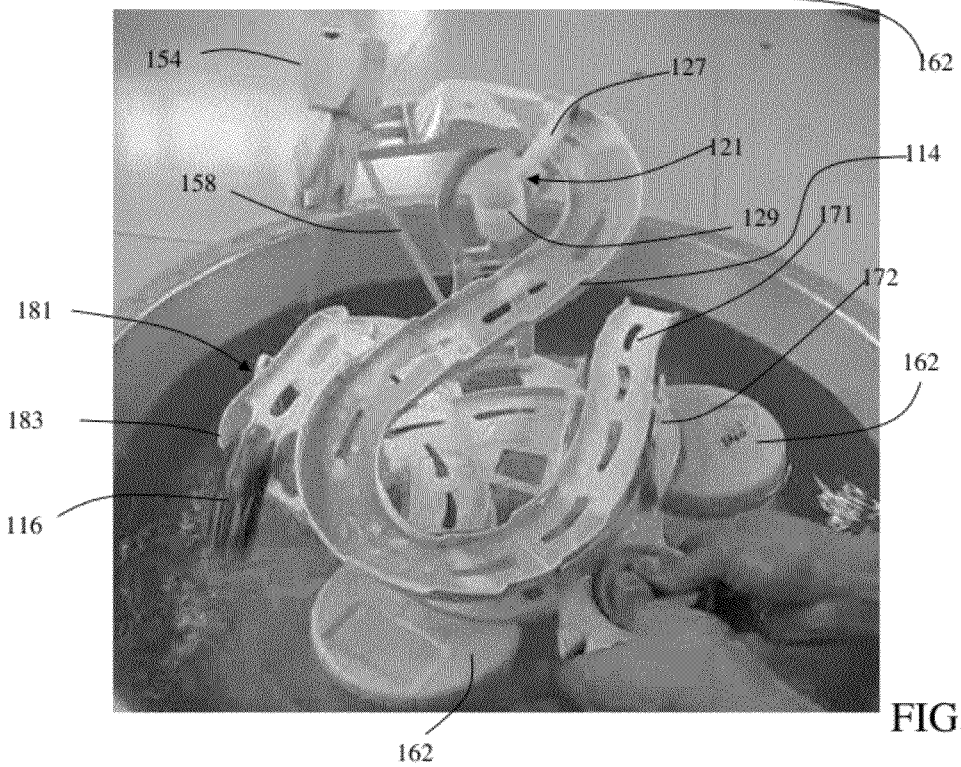
Figure 22:
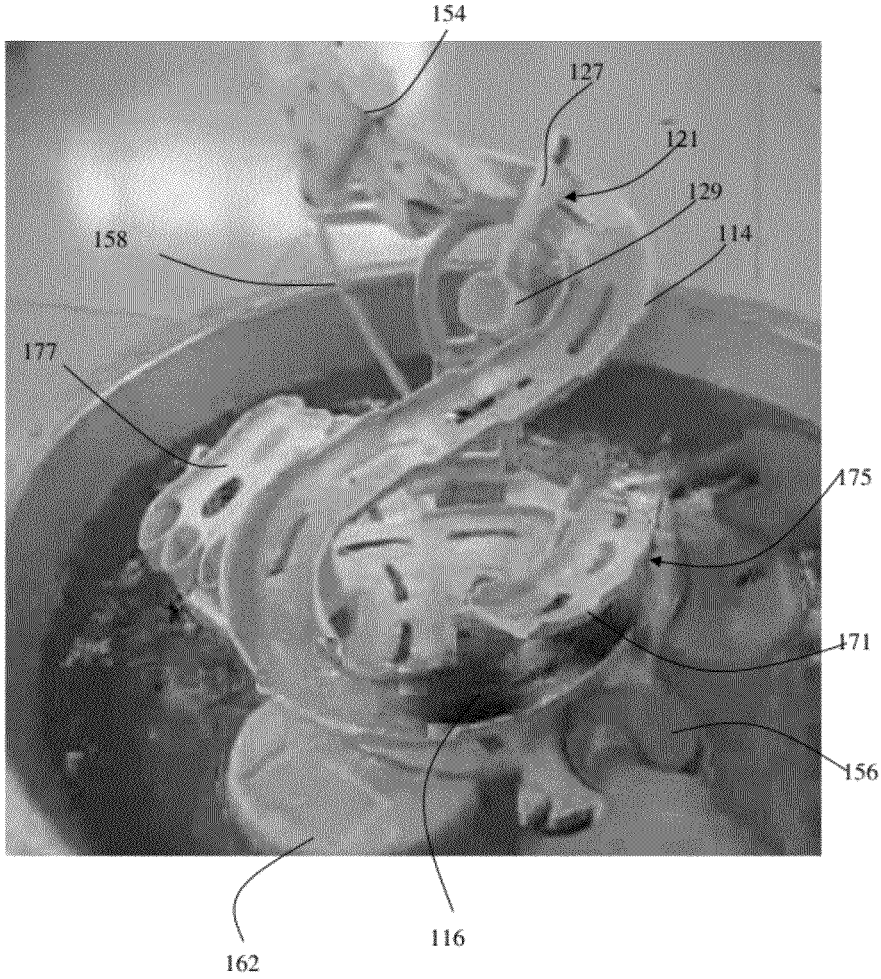

The floatable toy structure also has a gate 121 pivotally mounted to the floatable toy structure proximate to the collapsible track section, the gate is configured for movement between a first position 123 (FIG. 14) and a second position 125 (FIG. 19). The gate also has an arm member 127 secured to a vessel 129 for holding water therein, wherein the gate moves from the first position to the second position when a predetermined amount of water is placed into the vessel. As illustrated, the gate moves away from the collapsible track section as it moves from the first position towards the second position and an object such as a toy car 116 can travel down the track as the gate is moved to the second position.

Figure 14:
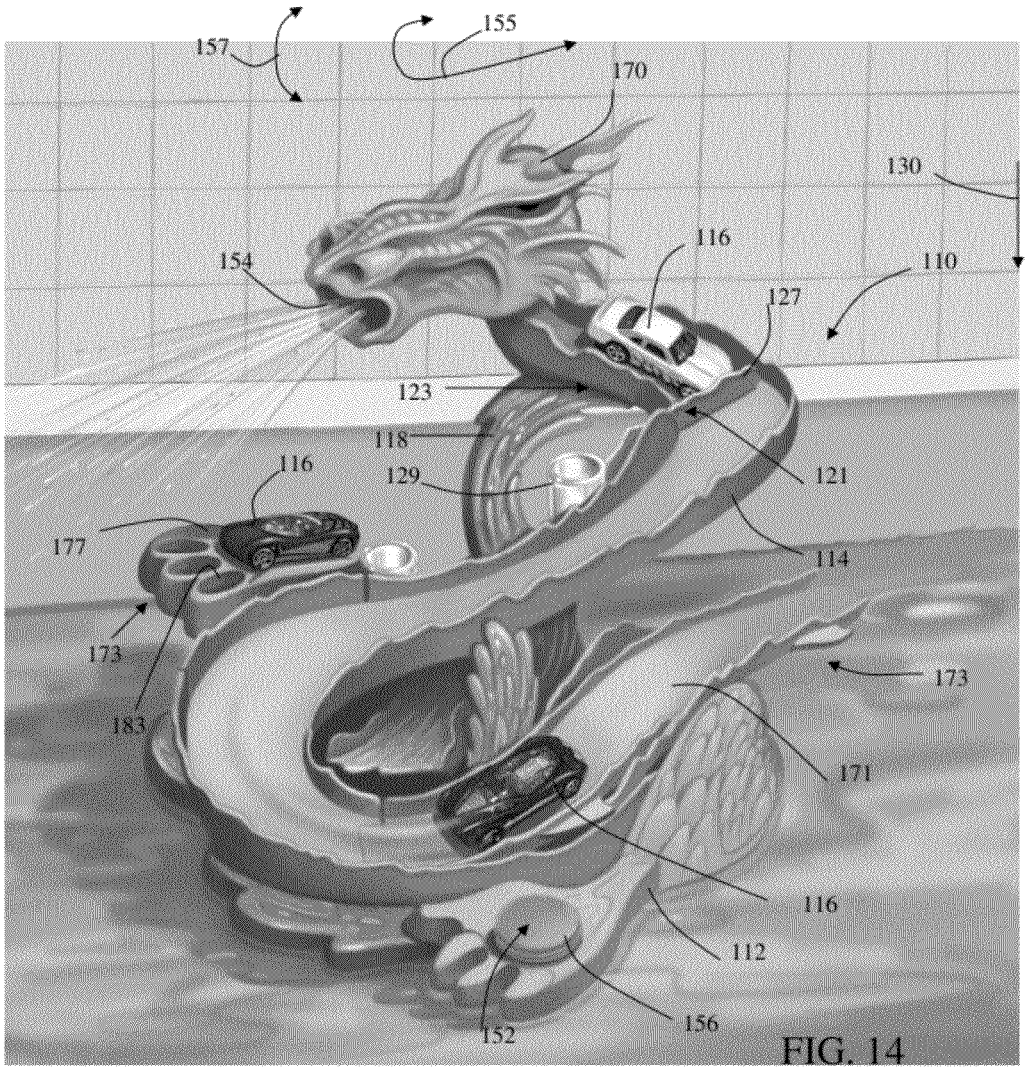
FIGS. 14-22 illustrate an alternative embodiment of the present invention.
Figure 15:
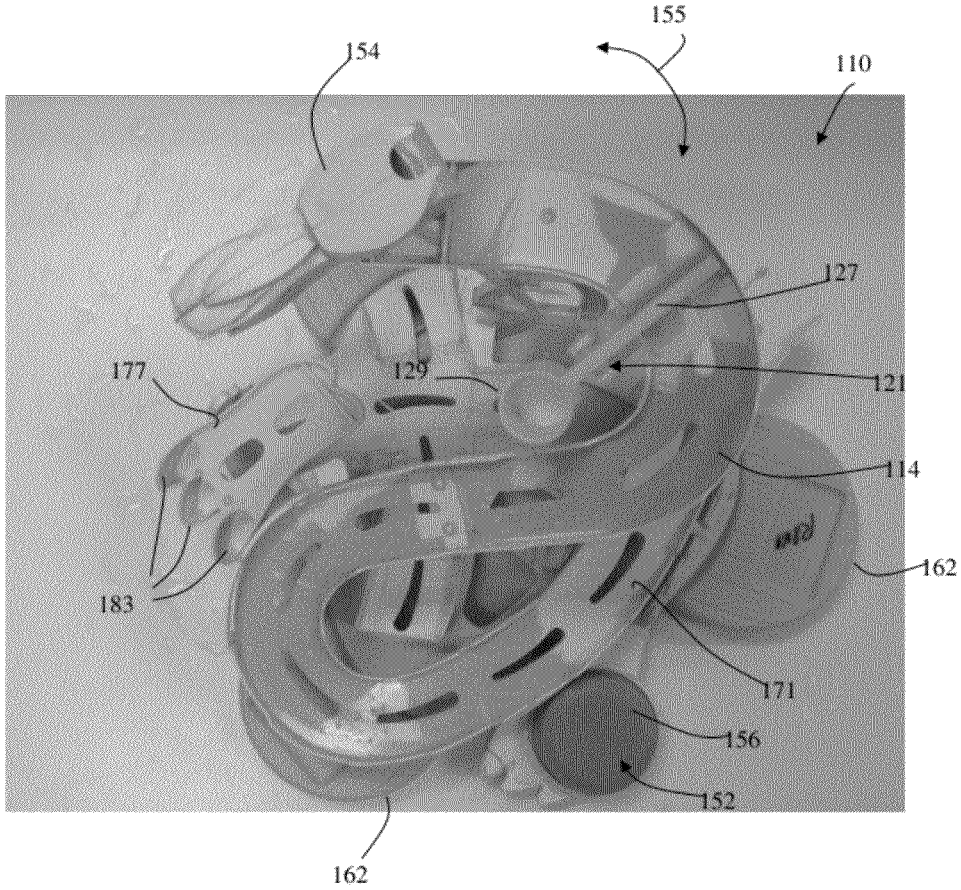
Figure 16:
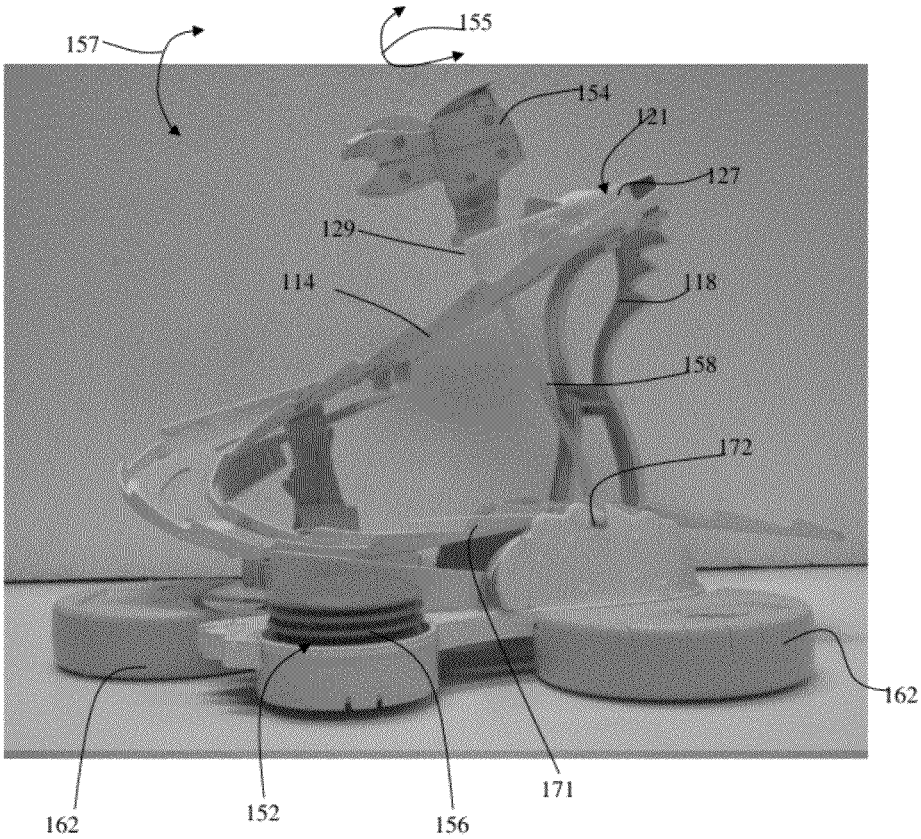
Figure 17:
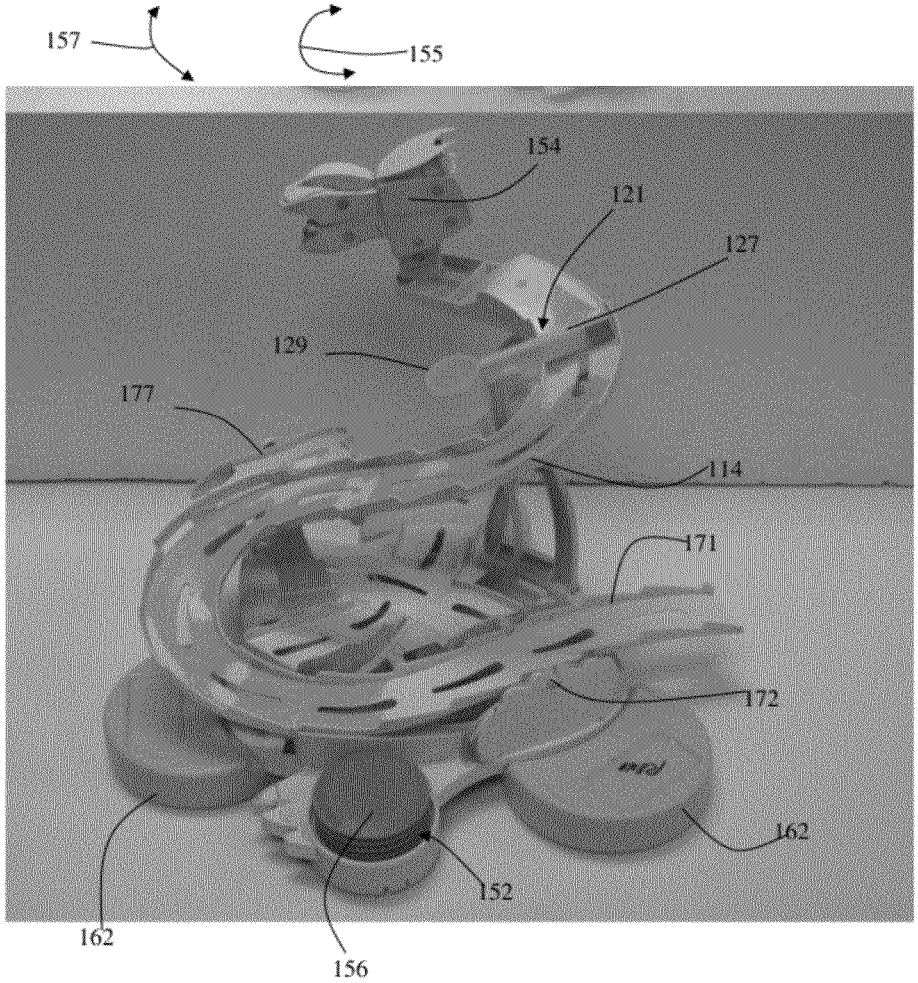
Figure 18:
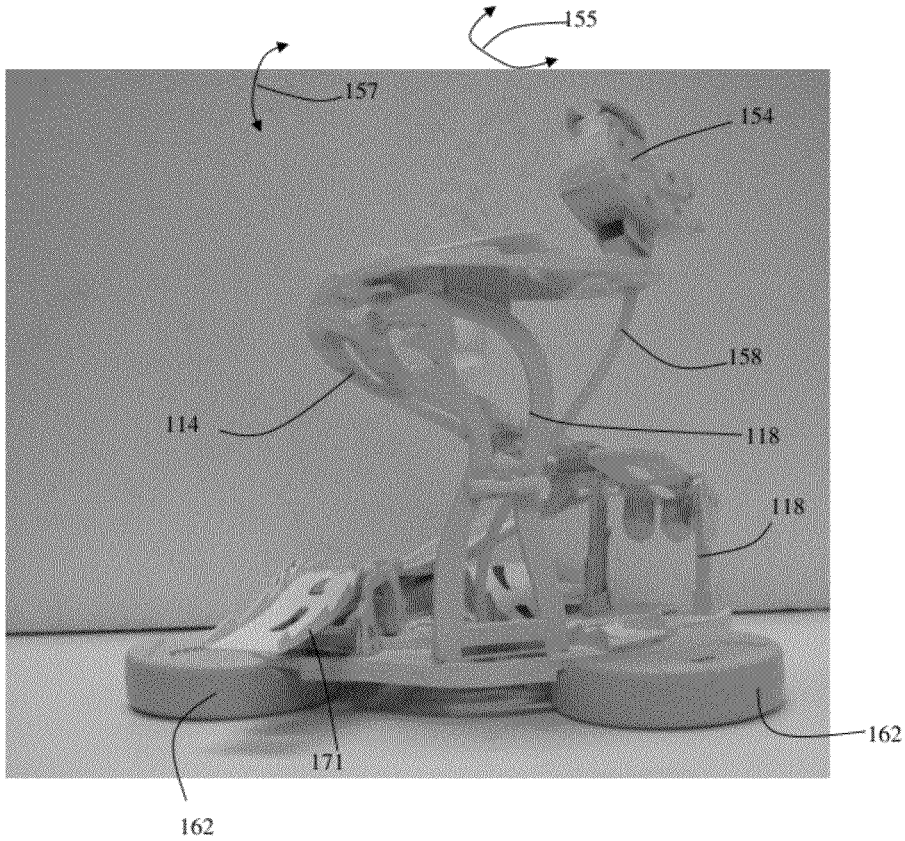

In an exemplary embodiment, water is sprayed into vessel 129 from the spray nozzle 154, which is repositionable in various directions illustrated by the arrows 155 and 157 in FIG. 14 such that the nozzle may be aimed in various directions. In one non-limiting embodiment, portions of the floatable toy structure are configured to resemble a sea creature and the spray nozzle is secured to or resembles a head 170 of the sea creature and the head is repositionable in various directions illustrated by the arrows 155 and 157 in FIG. 14 such that the nozzle may be aimed in various directions.

The floatable toy structure also has a track section 171 that is pivotally mounted to the floatable toy structure about a pivot point 172 for movement between a first position 173 (See at least FIG. 14) and a second position 175 (See at least FIG. 22) wherein the track section receives objects or cars 116 traveling down the collapsible track section when the track section is in the first position and wherein objects traveling down the collapsible track section travel beneath the track section along an alternate path when the track section in the second position.

The floatable toy structure also has a platform 177 pivotally mounted to the floatable toy structure. The platform is configured for movement between a first position 179 (See at least FIGS. 14 and 20) and a second position 181 (See at least FIG. 21). The platform also has at least one vessel 183 for holding water therein and the platform moves from the first position to the second position when a predetermined amount of water is placed into the at least one vessel. As illustrated in at least FIGS. 14, 20 and 21 the platform moves from a substantially horizontal position to an inclined position as it moves from the first position towards the second position, an object 116 placed on the platform will be dislodged therefrom as the platform moves from the first position to the second position. In another variation, the platform is a car washing station wherein when a car is washed off and the car is launched from the platform after the car is washed and the vessels are filed with water.

In one non-limiting embodiment, the platform is configured to resemble a foot or foot print of the sea creature.

As disclosed herein a method for releasing objects from a floatable toy structure is provided, the method includes the steps of pivotally mounting a gate to the floatable toy structure, wherein the gate moves from the first position to the second position when a predetermined amount of water is placed into the vessel. When the predetermined amount of water is placed in the vessel the gate moves away from the collapsible track section such that a toy object (such as a car) behind the gate can be released down the track. In one implementation, the water is pumped into the vessel of the gate from a repositionable nozzle in order to move the gate to the second position. In another embodiment, a movable platform located in another position of the floatable structure is moved from the first position to the second position when a predetermined amount of water is placed into the vessel and the platform moves from a substantially horizontal position to an inclined position and an object placed on the platform will be dislodged therefrom as the platform moves to the inclined position.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A floatable toy structure, comprising:

a floatable base portion;

a collapsible track section secured to the floatable base portion, the collapsible track section capable of being positioned in an extended position and a stowed position, the collapsible track section extending upwardly from the floatable base portion when it is in the extended position;

a support secured to the floatable base portion, the support configured to support the collapsible track section in the extended position;

a pump for spraying water from a spray nozzle movably secured to the floatable toy structure; and a gate pivotally mounted to the floatable toy structure proximate to the collapsible track section, the gate being configured for movement between a first position and a second position, the gate further comprising a vessel for holding water therein, wherein the gate moves from the first position to the second position when a predetermined amount of water is placed into the vessel and wherein the gate moves away from the collapsible track section as it moves from the first position towards the second position.

2. The floatable toy structure as in claim 1, further comprising a track section pivotally mounted to the floatable toy structure for movement between a first position and a second position wherein the track section receives objects traveling down the collapsible track section when the track section is in the first position and wherein objects traveling down the collapsible track section travel beneath the track section along an alternate path when the track section in the second position.

3. The floatable toy structure as in claim 2, wherein the objects travelling down the collapsible track section are toy vehicles.

4. The floatable toy structure as in claim 1, wherein the collapsible track section is configured for use with a toy vehicle.

5. The floatable toy structure as in claim 1, wherein the pump is a compressible bellows secured to the floatable base portion and a flexible conduit fluidly connects the pump to the spray nozzle.

6. The floatable toy structure as in claim 1, wherein the floatable base portion comprises a base platform and a plurality of floats secured thereto.

7. The floatable toy structure as in claim 1, wherein the collapsible track section is configured as a spiral path.

8. The floatable toy structure as in claim 1, further comprising a platform pivotally mounted to the floatable toy structure, the platform being configured for movement between a first position and a second position, the platform further comprising at least one vessel for holding water therein, wherein the platform moves from the first position to the second position when a predetermined amount of water is placed into the at least one vessel and wherein the platform moves from a substantially horizontal position to an inclined position as it moves from the first position towards the second position, wherein an object placed on the platform will be dislodged therefrom as the platform moves from the first position to the second position.

9. The floatable toy structure as in claim 8, further comprising a track section pivotally mounted to the floatable toy structure for movement between a first position and a second position wherein the track section receives objects traveling down the collapsible track section when the track section is in the first position and wherein objects traveling down the collapsible track section travel beneath the track section along an alternate path when the track section in the second position.

10. The floatable toy structure as in claim 9, wherein the objects travelling down the collapsible track section are toy vehicles.

11. The floatable toy structure as in claim 1, wherein portions of the floatable toy structure are configured to resemble a sea creature and the spray nozzle is secured to a head of the sea creature.

12. A floatable toy structure, comprising:

a floatable base portion;

a collapsible track section secured to the floatable base portion, the collapsible track section capable of being positioned in an extended position and a stowed position, the collapsible track section extending upwardly from the floatable base portion when it is in the extended position;

a support secured to the floatable base portion, the support configured to support the collapsible track section in the extended position;

a pump for spraying water from a spray nozzle movably secured to the floatable toy structure; and a platform pivotally mounted to the floatable toy structure, the platform being configured for movement between a first position and a second position, the platform further comprising at least one vessel for holding water therein, wherein the platform moves from the first position to the second position when a predetermined amount of water is placed into the at least one vessel and wherein the platform moves from a substantially horizontal position to an inclined position as it moves from the first position towards the second position, wherein an object placed on the platform will be dislodged therefrom as the platform moves from the first position to the second position.

13. The floatable toy structure as in claim 12, further comprising: a gate pivotally mounted to the floatable toy structure proximate to the collapsible track section, the gate being configured for movement between a first position and a second position, the gate further comprising a vessel for holding water therein, wherein the gate moves from the first position to the second position when a predetermined amount of water is placed into the vessel and wherein the gate moves away from the collapsible track section as it moves from the first position towards the second position.

14. The floatable toy structure as in claim 13, further comprising a track section pivotally mounted to the floatable toy structure for movement between a first position and a second position wherein the track section receives objects traveling down the collapsible track section when the track section is in the first position and wherein objects traveling down the collapsible track section travel beneath the track section along an alternate path when the track section in the second position.

15. The floatable toy structure as in claim 14, wherein the objects travelling down the collapsible track section are toy vehicles.

16. The floatable toy structure as in claim 12, wherein the pump is a compressible bellows secured to the floatable base portion and a flexible conduit fluidly connects the pump to the spray nozzle.

17. The floatable toy structure as in claim 12, wherein the floatable base portion comprises a base platform and a plurality of floats secured thereto and wherein the collapsible track section is configured as a spiral path.

18. The floatable toy structure as in claim 12, wherein portions of the floatable toy structure are configured to resemble a sea creature and the spray nozzle is secured to a head of the sea creature.

19. A method of releasing objects from a floatable toy structure, comprising:

pivotally mounting a gate to the floatable toy structure, the gate being located proximate to a collapsible track section of the floatable toy structure, the gate being configured for movement between a first position and a second position, the gate further comprising a vessel for holding water therein, wherein the gate moves from the first position to the second position when a predetermined amount of water is placed into the vessel and wherein the gate moves away from the collapsible track section as it moves from the first position towards the second position; and pumping water into the vessel of the gate in order to move the gate to the second position, wherein an object placed behind the gate will travel down the collapsible track section after the gate moves to the second position.

20. The method as in claim 19, wherein the floatable structure further comprises:

a track section pivotally mounted to the floatable toy structure for movement between a first position and a second position wherein the track section receives objects traveling down the collapsible track section when the track section is in the first position and wherein objects traveling down the collapsible track section travel beneath the track section along an alternate path when the track section in the second position; and a platform pivotally mounted to the floatable toy structure, the platform being configured for movement between a first position and a second position, the platform further comprising at least one vessel for holding water therein, wherein the platform moves from the first position to the second position when a predetermined amount of water is placed into the at least one vessel and wherein the platform moves from a substantially horizontal position to an inclined position as it moves from the first position towards the second position, wherein an object placed on the platform will be dislodged therefrom as the platform moves from the first position to the second position.

* * * * *